US010947732B2

(12) United States Patent
Rabin et al.

(10) Patent No.: US 10,947,732 B2
(45) Date of Patent: Mar. 16, 2021

(54) ADJUSTABLE SKYLIGHT GUARD

(71) Applicants: JBLequipment, LLC, Deerfield, IL (US); FRANK P. FREY AND COMPANY, Bensenville, IL (US)

(72) Inventors: Mitchell Rabin, Deerfield, IL (US); Brian Joy, Plainfield, IL (US)

(73) Assignees: JBLequipment, LLC, Deerfield, IL (US); FRANK P. FREY AND COMPANY, Bensenville, IL (US)

( * ) Notice: Subject to any disclaimer, the term of this patent is extended or adjusted under 35 U.S.C. 154(b) by 0 days.

(21) Appl. No.: 16/443,101

(22) Filed: Jun. 17, 2019

(65) Prior Publication Data

US 2019/0383018 A1 Dec. 19, 2019

Related U.S. Application Data

(60) Provisional application No. 62/687,020, filed on Jun. 19, 2018, provisional application No. 62/803,269, filed on Feb. 8, 2019.

(51) Int. Cl.
*E04D 13/03* (2006.01)

(52) U.S. Cl.
CPC ..... *E04D 13/0335* (2013.01); *Y10S 256/06* (2013.01)

(58) Field of Classification Search
CPC .. E04D 13/0335; Y10S 256/02; Y10S 256/06; Y10S 52/12
See application file for complete search history.

(56) References Cited

U.S. PATENT DOCUMENTS

| | | | | |
|---|---|---|---|---|
| 1,772,142 | A | 8/1930 | Goodrich | |
| 6,209,271 | B1 | 4/2001 | Kovacs | |
| 6,272,800 | B1 * | 8/2001 | Phinney | E04D 13/0335 182/112 |
| 7,300,037 | B2 | 11/2007 | Beirne, Jr. et al. | |
| 7,516,575 | B2 | 4/2009 | Cuccurullo | |
| 7,516,816 | B2 * | 4/2009 | Higgs | E04D 13/0335 182/113 |
| 8,122,673 | B2 | 2/2012 | Ellis et al. | |
| 8,522,487 | B2 * | 9/2013 | Whiting | E06B 5/00 52/19 |
| 8,915,023 | B2 * | 12/2014 | Whiting | E02D 29/127 52/19 |
| 9,045,906 | B1 * | 6/2015 | Richey | E04D 13/00 |
| 9,212,489 | B1 | 12/2015 | Erickson | |
| 9,226,575 | B2 | 1/2016 | Crowley | |
| 10,501,942 | B2 * | 12/2019 | Palasek | E04B 7/18 |

(Continued)

*Primary Examiner* — Andrew J Triggs
(74) *Attorney, Agent, or Firm* — Greer, Burns & Crain, Ltd.

(57) ABSTRACT

A skylight guard is provided for placement upon a skylight having a peripheral frame, and includes at least one generally vertical leg having an upper end and a lower end, at least one horizontal member having a first end, an opposite second end, and a middle portion located between the first and second ends. At least one of the first and second ends is configured for attachment to a corresponding one of the at least one leg. At least one of the horizontal members is axially variable, and at least one of the vertical legs has a foot associated with the lower end, the foot being constructed and arranged to contact the peripheral frame.

13 Claims, 9 Drawing Sheets

(56) References Cited

U.S. PATENT DOCUMENTS

| | | | | |
|---|---|---|---|---|
| 2004/0104382 | A1* | 6/2004 | Collins | E04G 21/3223 256/59 |
| 2007/0228352 | A1* | 10/2007 | Higgs | E04G 21/3233 256/59 |
| 2012/0216464 | A1 | 8/2012 | Bonapace | |
| 2016/0362934 | A1* | 12/2016 | Swafford | E06B 3/921 |
| 2018/0112413 | A1* | 4/2018 | Palasek | E04H 17/22 |
| 2019/0383018 | A1* | 12/2019 | Rabin | E04D 13/0335 |

* cited by examiner

ADJUSTABLE SKYLIGHT GUARD

RELATED APPLICATION

This application is a Non-Provisional of, and claims 35 USC 119 priority from, U.S. 62/687,020 filed Jun. 19, 2018 and U.S. 62/803,269 filed Feb. 8, 2019, the contents of which are incorporated by reference herein.

BACKGROUND

A common architectural practice in the design of homes and commercial buildings is to utilize skylights to provide or increase the amount of natural light to the interior. Skylights are exposed to falling debris, and their natural deterioration (e.g., turning brittle) increases the likelihood of breakage. In addition, the Occupational Safety and Health Administration (OSHA) considers the flat rooftops common to commercial or industrial buildings "walking-working surface[s]," and has promulgated regulations that require skylights and other such rooftop structures to be guarded for worker benefit. These regulations are found generally at 29 CFR 1910.23. More specifically, 29 CFR 1910.23(a)(4) and 29 CFR 1910.23(e)(8) require all exposed sides of a skylight on such roofs to be guarded in a manner sufficient to repel a force of 200 lbs from breaking the glass.

Skylight guard systems have been developed to protect against damage and comply with OSHA regulations. However, several problems exist with these developments. Fasteners that penetrate the frame of a skylight can lead to leaks. Alternatives that employ tension for stability can loosen over time, especially when subjected to the increased wind strength to which rooftops at certain altitudes are exposed. Attempting to circumvent these issues presents challenges to the efficient use of skylight guarding equipment, as convenience and maneuverability are compromised when sturdier assemblies are used.

A general lack of versatility also plagues the industry. Skylight guards are conventionally provided in fixed size or customized (i.e., built ad hoc to envelope a certain size skylight frame). Another drawback of conventional skylight guards is that any adjustability for accommodating variations in skylight dimensions has been located in a location on the guard that is difficult for workers to access for adjustment. That is, a larger skylight guard system might be placed around a smaller frame using bars or clamps located within the larger structure, but the rooftop space forfeited to the system is not altered by these adjustments. As such, space use does not reflect the smaller size of a skylight frame. Though not explicitly addressed by OSHA, spatial congestion is an obvious concern for rooftop workers. Thus, there is a need for an improved skylight guard system that addresses the drawbacks listed above.

SUMMARY

The above-identified need is addressed by the present skylight guard. A conventional rectangular skylight frame has a vertical surface and a top surface. In a preferred embodiment, the present skylight guard engages both the top and side surfaces using a plurality of angled legs, each defining two surfaces, which engage the vertical surfaces of the frame, and each leg having a laterally projecting foot that engages the frame top surface. In the preferred embodiment, the legs are perforated, which provides a plurality of mounting positions for the foot. Using threaded fasteners, welding or the like, the foot is attached to the legs. With the combined engagement of the legs and feet with the skylight frame, the present skylight guard is securely held onto the frame, even in the face of windy conditions, or impact with workers. In addition, the adhesion of the present skylight guard to the skylight is enhanced by the use of axially variable, retractable, or expandable horizontal members which connect the vertical legs together.

In the present guard, each horizontal member, has two end portions that overlap in a middle portion. Each middle portion is slotted, and the members are secured together with fasteners. A length of each horizontal member is adjustable by way of a sliding mechanism that allows the two separate ends to move laterally relative to each other. Sliding the opposing ends of horizontal members together or apart requires only the loosening of the fasteners, preferably bolts situated within collinear channels or tracks of the middle portions. Tightening the bolts locks the horizontal members at a desired length. Alternatives that include linearly spaced mounting holes, designated slots for these bolts or adjustable clamps that hold the horizontal members together at a designated length are also contemplated, in addition to a general track. In addition, Adjustment of the length of the horizontal members preferably exerts a clamping tension that is used to fortify the gripping relationship of the guard on the skylight frame.

In effect, the mechanism facilitates horizontal expansion to roughly twice a minimum length, which is defined by the individual lengths of opposing and complementary portions of each horizontal member. When axial contraction is sought, surrounding space is not used beyond the frame of a skylight. Per the preferred embodiment of this skylight guard, adjustable-length horizontal members are placed along all sides of an enclosure to provide bi-axial contraction and extension. Other options are considered should unilateral expansion be favored. In any case, the sliding mechanism described makes clear that spatial congestion need no longer attenuate the convenience offered by versatility.

Another feature of the present guard is a cover, which is contemplated as being made of wooden boards, such as of plywood, or open cloth netting. It is preferred that the cover is secured to the horizontal members by fasteners, clamps or the like as is well known in the art. In addition to tension is used to fortify the assembly's hold around a skylight's frame, the adjustments can be used to pull the covering net into a taut orientation sufficient to repel a force of 200 lbs. The use of other materials, such as wooden boards, is also contemplated for possible covers.

More specifically, a skylight guard is provided for placement upon a skylight having a peripheral frame, and includes at least one generally vertical leg having an upper end and a lower end, at least one horizontal member having a first end, an opposite second end, and a middle portion located between the first and second ends. At least one of the first and second ends is configured for attachment to a corresponding one of the at least one leg. At least one of the horizontal members is axially variable, and at least one of the vertical legs has a foot associated with the lower end, the foot being constructed and arranged to contact the peripheral frame.

In another embodiment, a skylight guard for placement upon a skylight having a peripheral frame is provided, including at least one generally vertical leg having an upper end and a lower end, the lower end having a surface that engages an edge of the peripheral frame. At least one horizontal member has a first end, an opposite second end, and a middle portion located between the first and second ends. At least one of the first and second ends being configured for engagement with a corresponding one of the at least one leg. At least one of the horizontal members and said legs being axially variable; and any number of the at least one leg being constructed and arranged to allow said at least one leg to engage the peripheral frame.

In one embodiment, each horizontal member is slidably engaged in eyelets on vertically adjustable portions of the legs. In one embodiment, each horizontal member is a beam of conventional lumber. In one embodiment, the lower end of the leg clampingly engages the skylight frame. In one embodiment, each leg includes a vertically adjustable portion provided with eyelets.

In yet another embodiment, a skylight guard is provided for placement upon a skylight having a peripheral frame, and includes at least two generally vertical legs having an upper end and a lower end, the lower end having a surface that engages an edge of the peripheral frame, at least one of the vertical legs having a foot associated with the lower end, the foot being constructed and arranged to allow the leg to sit atop the peripheral frame. At least one horizontal member having a first end and an opposite second end, both of the ends being configured for attachment to at least one associated site of the at least two legs. At least one horizontal member further including a first sliding portion and a second sliding portion constructed and arranged to slide relative to the first sliding portion for adjusting an axial length of the at least one horizontal member. At least one cover mounted to any number of the at least one horizontal member and extending over a space defined by a perimeter of the peripheral frame.

In the preferred embodiment, each leg has a surface engaging an edge of the frame. Each leg is preferably a length of angle iron with two non-coplanar surfaces, each of the surfaces contacting a separate edge portion of the frame. Also, it is preferred that each leg has multiple mounting points for connection with each horizontal member and for accommodating the associated feet. At least one horizontal member has an upper edge, and a lip projecting laterally from the upper edge, the lip supports a cover, which is one of a board and a net.

In the preferred embodiment, the axial variability of each horizontal member is provided by a first sliding portion and a second sliding portion constructed and arranged to slide relative to the first sliding portion for adjusting an axial length of the horizontal member. Accordingly, each horizontal member further includes slots and holes in the complementary, preferably middle portion serving as the sliding portions. Also, it is preferred that the present guard include a pair of vertically spaced horizontal members mounted between each pair of legs.

DETAILED DESCRIPTION

Figure 1:
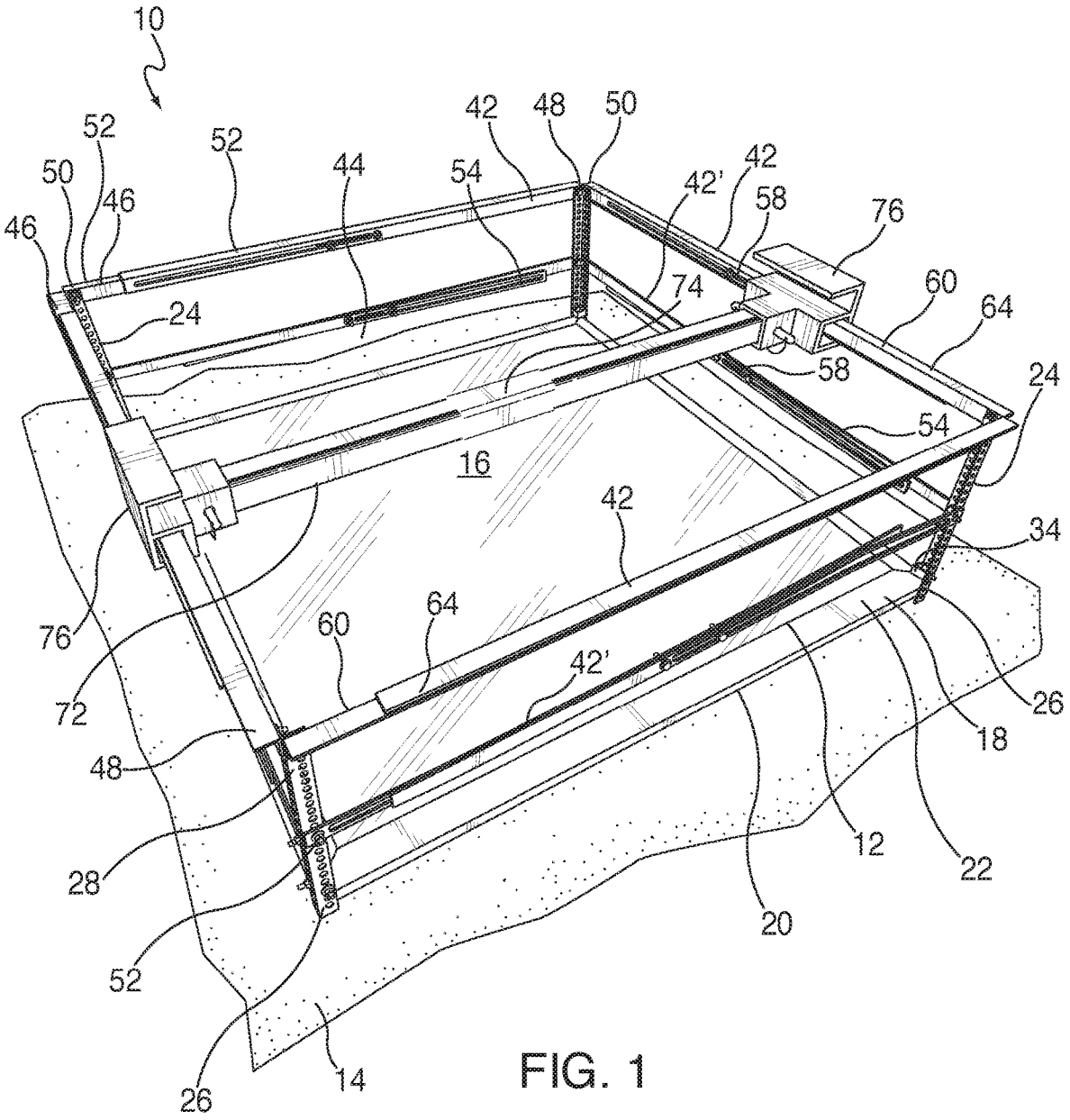
FIG. 1 is a top perspective view of the present skylight guard.

Referring now to FIGS. 1 and 4-6, the present skylight guard, generally designated 10, is shown. The guard 10 is well suited for placement around a skylight 12 on a flat roof 14. A skylight glass 16 is held in place by a surrounding frame 18, and offers a sturdy foundation about which the present guard 10 can be mounted. It is understood, however, while the preferred application for the present guard 10 is for protecting a skylight, the guard has equal applicability to openings in substrates other than skylights, such as those in floors or locations other than rooftops Included in the skylight frame 18 is a peripheral, or vertical surface 20 and an upper surface 22 which both are utilized in supporting the preferred embodiment of the present skylight guard. At least one but ideally multiple generally vertical legs 24 are placed along the frame, such that a lower end 26 of each leg contacts the peripheral surface 20 of the skylight frame 18 and an opposite, upper end 28 of each, generally vertical leg is elevated above that point of contact. When, as in one embodiment, the generally vertical legs 24 are perforated angle iron, two peripheral surfaces 20 at the corner of the skylight frame 18 are engaged by the leg. This contact enhances retention of the guard 10 on the skylight frame 18. Solid vertical legs 24 are also contemplated.

Figure 4:
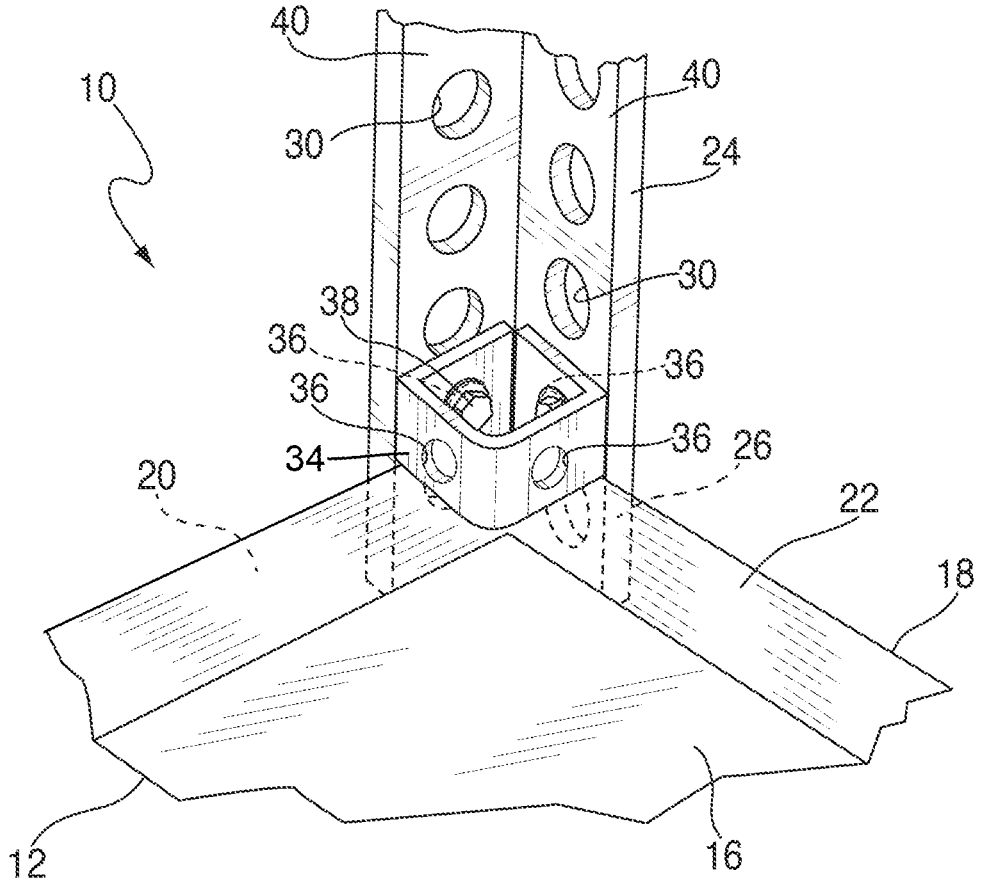
FIG. 4 is an enlarged fragmentary perspective view of the present skylight guard showing the leg and foot construction.

Referring now to FIG. 4, perforations 30 in the angle iron legs 24 provide variable heights at which a third point of contact with the skylight frame 18 is attached. While alternatives are contemplated, a foot 34 is formed by a similarly perforated strip of metal that rests atop the upper surface 22 of the skylight frame 18. Perforations or slots 36 are aligned with those perforations 30 of an associated leg 24 and the desired leg-foot complex is created using fasteners 38, preferably nuts and bolts, each complementary pair connecting the foot 34 to one face of the angle iron leg. In both embodiments, which are not intended to comprise an exhaustive list of what has been considered, interior surfaces 40 of the leg 24 preferably engage the corresponding two surfaces 20 forming a corner of the skylight frame 18, and the foot 34 is mounted on the leg so it contacts or engages the upper surface 22 of the frame. It is also contemplated that the foot 34 is welded to the leg 24.

Figure 5:
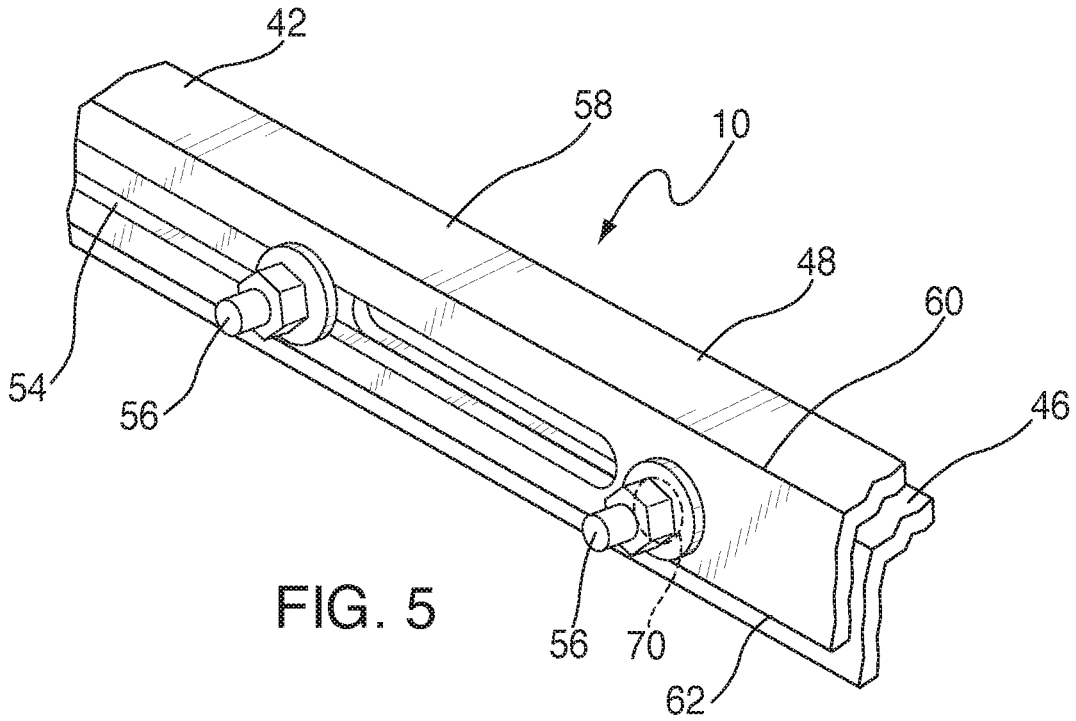
FIG. 5 is an enlarged fragmentary top perspective view of a horizontal member of the present skylight guard.
Figure 6:
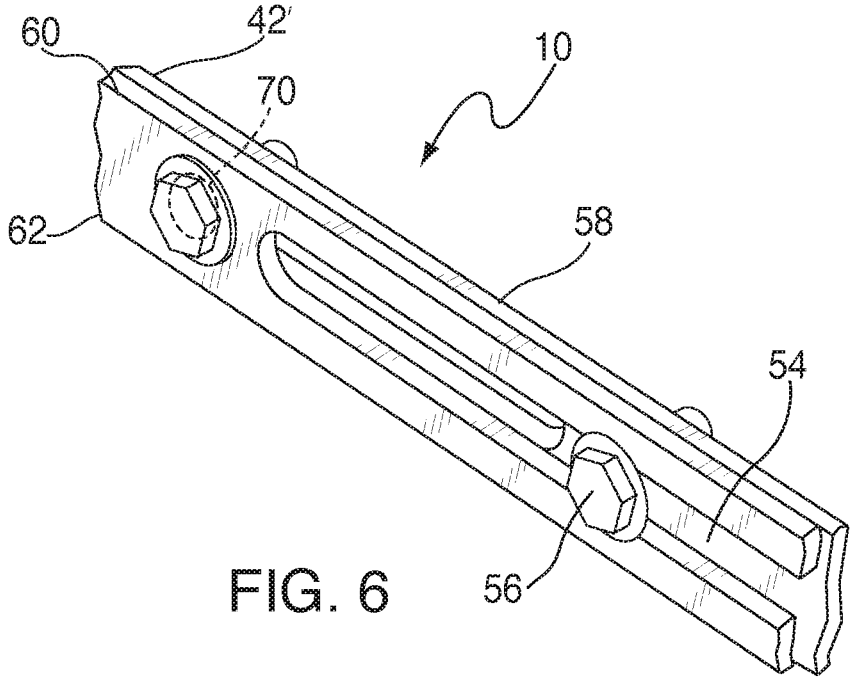
FIG. 6 is an enlarged fragmentary top perspective view of an alternate horizontal member.

Referring now to FIGS. 1, 5 and 6, moreover, the perforated legs 24 also provide attachment points for at least one, and preferably a plurality of horizontal members 42. In the preferred embodiment, a horizontal member 42 connects each pair of legs 24 and are arranged to create an enclosure 44, preferably a rectangle or square. However, other closed polygons, or other shapes of the enclosure 44 are contemplated. The horizontal members 42 have a first end 46 and an opposite second end 48, each of which has an eyelet 50 used to engage or attach the end to the selected perforations 30 in the leg 24. Fasteners 52, preferably threaded bolts and nuts or the like, are provided to secure the horizontal members 42 to the legs 24. Opposite the eyelet 50, each of the first and second ends 46, 48 has a slot 54. The horizontal member 42 is assembled by securing the opposing slots 54 in overlapping or aligned fashion and securing them using reclosable fasteners 56, preferably nuts and bolts or the like. The connection is secured by tightening the fasteners 56 when a desired length is achieved for the horizontal member 42.

A middle portion 58 of each horizontal member 42 is located between the ends 46, 48 and is configured to be variably expanded (extended or retracted) along a generally horizontal axis by the operator upon installation on the skylight frame 18. The fasteners 54 are temporarily loosened during installation to enable the horizontal member 42 to be fit to the length of the frame 18. Once properly sized, the fasteners 54 are tightened. It is also contemplated that the horizontal members are slidably adjusted relative to each other, and are held in place using a clamp, preferably having a set screw or threaded tension member.

Referring now to FIGS. 1-3 and 5 and 6, it is also contemplated that the horizontal members 42 have an upper end 60 and a lower end 62. In the preferred embodiment, the upper end 60 is provided with a laterally projecting lip 64. One or both of the first and second ends 46, 48 are provided with the lip 64, which when both ends have the lips, they overlap each other. Also, the lips 64 preferably extend in the same direction (FIG. 5).

Figure 2:
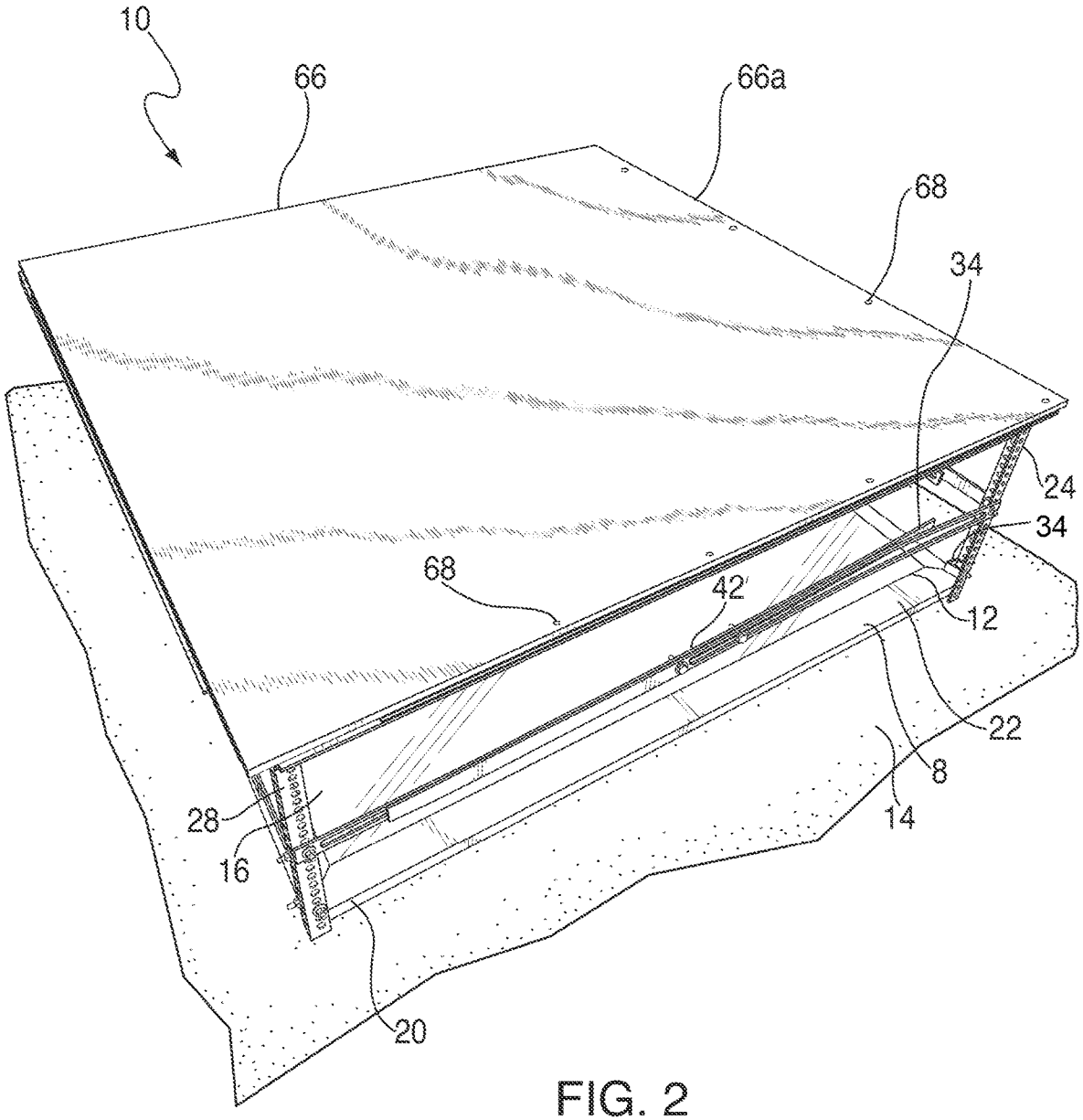
FIG. 2 is a top perspective view of the present skylight guard with a cover made of a board.
Figure 3:
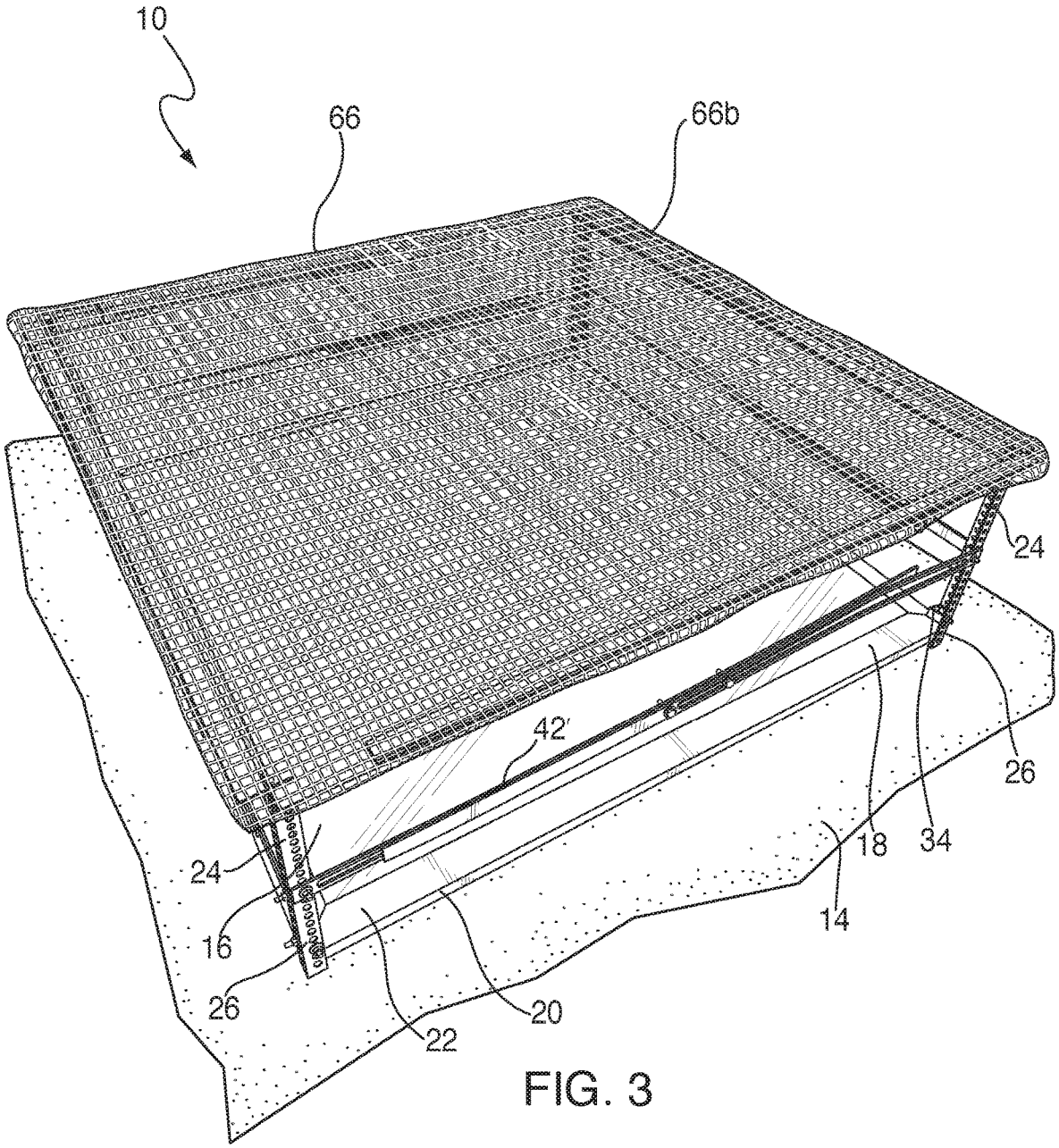
FIG. 3 is a top perspective view of the present skylight guard with a cover make of a net.

This laterally projecting lip 64 is used to support a cover 66, which itself can be any number of wooden boards or other materials, situated and extending over the skylight and its frame. A wooden cover 66 is shown in FIG. 2 as 66*a*, and a net cover 66 is shown in FIG. 3 as 66*b*. When the net cover 66*b* is employed, it is assembled on the lip 64 at sufficient tension for compliance with OSHA regulations. Suitable fasteners 68, such as screws, clamps, chemical adhesive or the like, well known in the art, secure the cover 66 to the lip 64. In an alternate embodiment, a net 66' is used as the skylight guard cover 66.

Referring again to FIG. 1, it is contemplated that a supplemental support 72 is releasably, clampingly secured at each end to the upper end 60 of opposing upper horizontal members 42. The supplemental support 72, which is made up of a pair of overlapping, preferably "L"-shaped members like the horizontal members 42, is axially adjustable in length and is held in a desired position by at least one clamp 74. The clamp 74 is configured by manipulation by the user to hold the telescoping members in position, as by a thumbscrew or the like. In addition, the supplemental support 72 is secured to the horizontal members 42 using clamps 76, also releasably tightened by the user.

Figure 7:
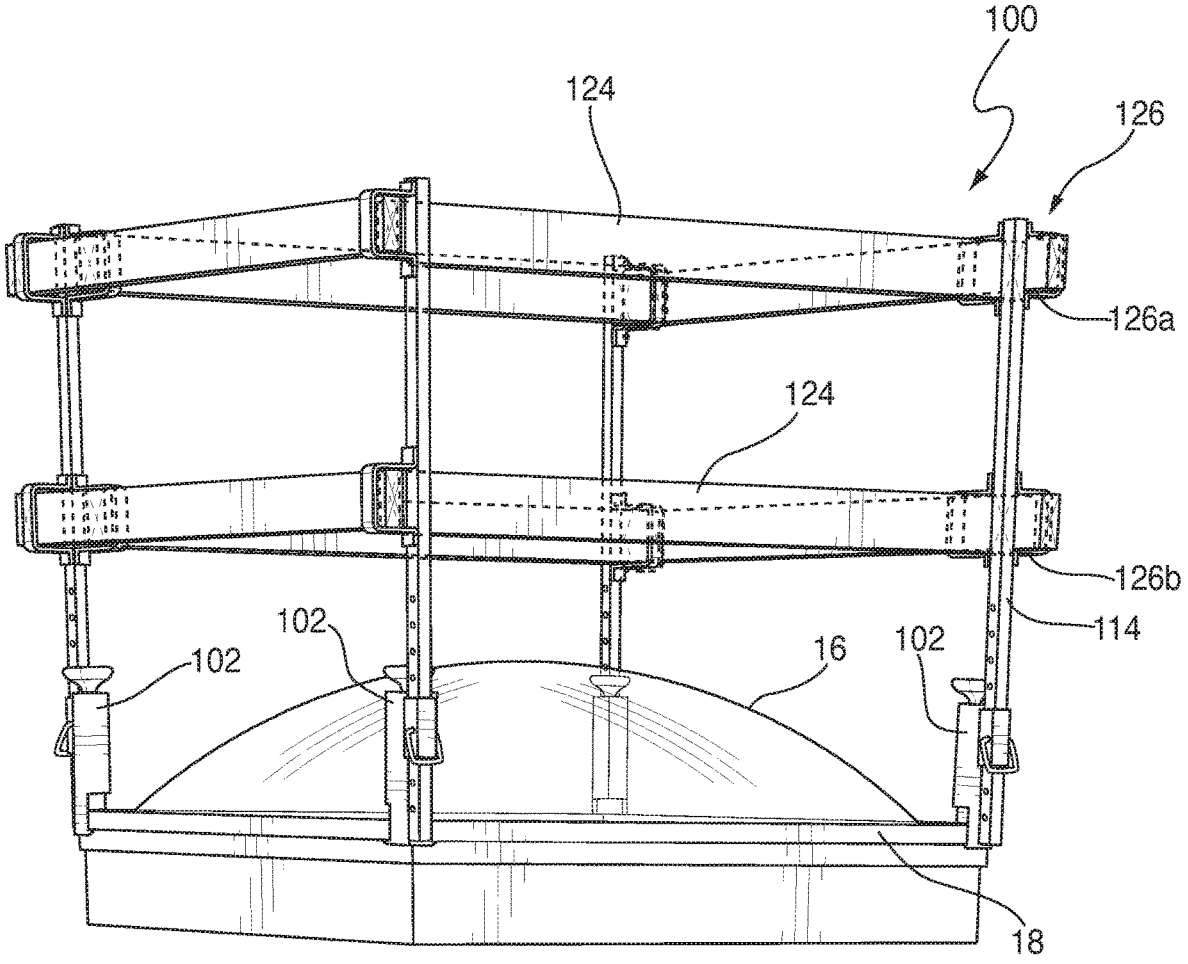
FIG. 7 is a perspective view of an alternate embodiment of the present skylight guard shown mounted to a skylight.
Figure 8:
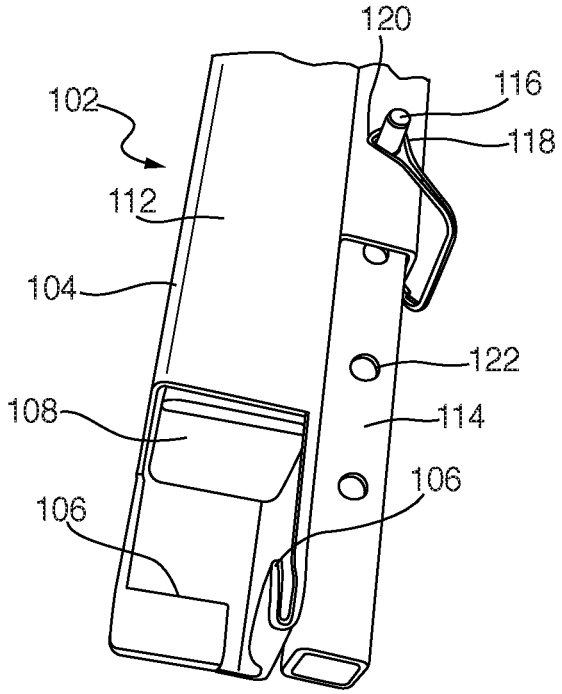
FIG. 8 is a fragmentary perspective view of a base of a vertical leg member of the skylight guard of FIG. 7.
Figure 9:
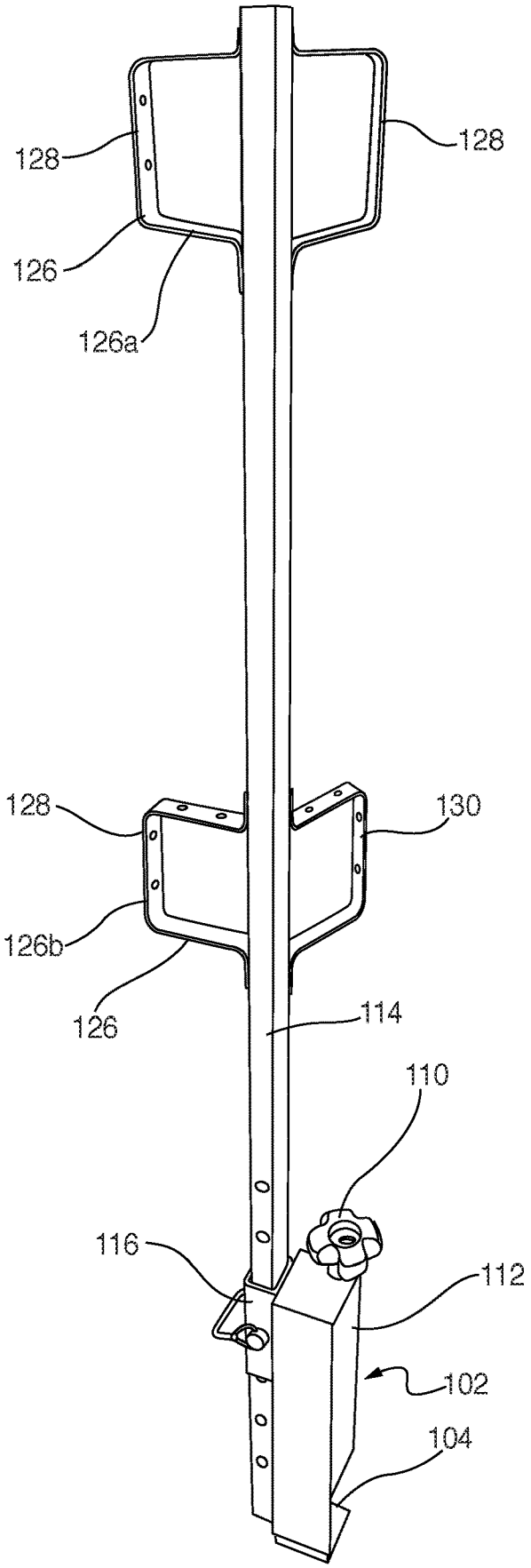
FIG. 9 is a perspective view of one of the vertical leg members of the skylight of FIG. 7

Referring now to FIGS. 7-9, another embodiment of the present skylight guard is generally designated 100. Components shared with the embodiment 10 are designated with identical reference numbers. Important distinctions between the embodiments 10 and 100 include that the latter is secured by clamps to the skylight frame 18, the generally vertical leg 102 is axially adjustable and the horizontal members are slidingly engaged in the legs. More specifically, the vertical leg 102 is provided with a foot 104 having a shoulder or inner hook 106 that engages an underside of the skylight frame 18. An adjustable plate 108 engages or rests upon the upper surface 22 of the frame 18. Vertical adjustment of the plate 108 is achieved by use of a rotatable knob 110 that is connected to the plate by a threaded rod (not shown). The rod is threadably engaged in bulkhead or other support (not shown) in a foot housing 112 that is preferably hollow, and allows relative vertical sliding action of the plate 108 as the rod is rotated by the knob 110.

The leg 102 is secured to the skylight frame 18 by hooking the shoulder 106 under the frame, then, using the knob 110, lowering the plate 108 until a snug fit is achieved relative to the upper surface 22. In this embodiment 100, the leg 102 also includes a vertically adjustable portion 114 that is slidable secured in a tube 116 attached to one side of the foot housing 112. A cotter pin 118 or the like slidably engaged in a throughbore 120 in the tube 116 engages a selected one of a plurality of vertically spaced mounting holes 122 in the vertically adjustable portion 114. Thus, the height of the vertically adjustable portion 114 is varied relative to the skylight 12.

Another feature of the skylight guard 100 is that the vertical legs 102 slidably accommodate the horizontal members 124, which in the present embodiment are standard wooden beams sold at lumber yards, such as 2×4's 1×3's 2×3's or the like. The horizontal members 124 are slid into eyelets 126 which are secured to the vertically adjustable portions 114, as by welding, fasteners or other conventional technology. In the preferred embodiment, each vertically adjustable portion 114 has upper and lower eyelets 126*a*, 126*b*.

Each eyelet 126 has a first component 128 extending in a first direction, and a second component 130 extending in a direction 90° displaced from the first component. Thus, the components 128, 130 appear "V"-shaped when viewed from above. This arrangement is provided for accommodating the horizontal members 124 that correspond respectively to the length and width of the skylight frame 18. It is contemplated that the angular orientation of the components 128, 130 to the vertically adjustable portion 114 may vary to suit the application.

In use, the four vertical legs 102 are each secured to a respective area preferably a corner of the skylight frame 18. Then, the height of the vertically adjustable portions 114 are adjusted so that all are at the same height. Lastly, the horizontal members 124 are slidably inserted into the eyelets, to create a surrounding structure that protects the skylight 18 (see FIG. 7).

Figure 10:
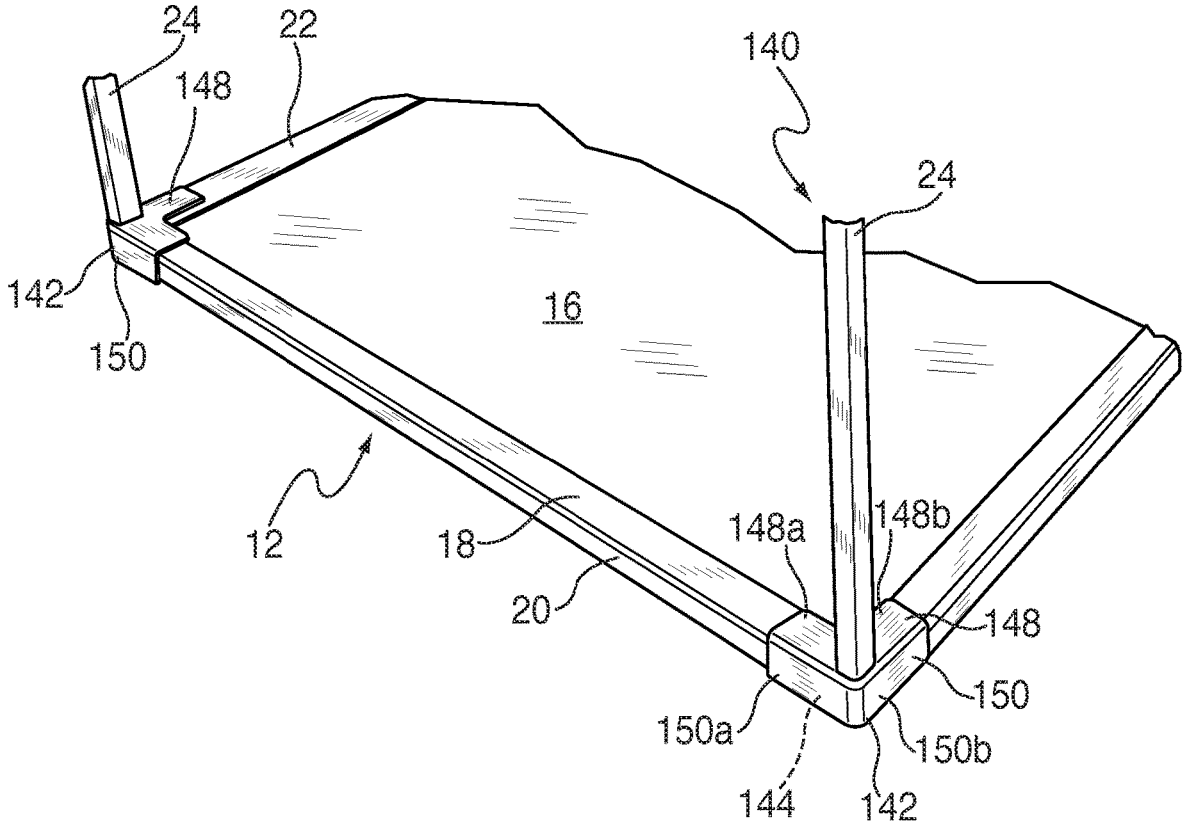
FIG. 10 is an enlarged fragmentary perspective view of another embodiment of the leg and foot construction of the present skylight guard.

Referring now to FIG. 10, an alternate embodiment of the present skylight cover 10 having modifications to the leg 24 and the foot 34 is shown fragmentarily and is generally designated 140. Components shared with the skylight guard 10 are designated with identical reference numbers. The skylight cover 140 incorporates the features of the cover 10, with only the foot 34 being modified. In the embodiment 140, a main distinguishing feature is that a foot 142 replaces the foot 34. In general, the foot 142 is configured for enveloping a corner 144 (designated in phantom) formed by the upper surface 22 of the skylight frame 18, as well as the peripheral vertical edge 20 of the frame.

More specifically, each of the feet 142 includes a preferably integral "L"-shaped piece having a generally horizontal surface 148 and a generally vertical surface 150. One facet 148*a*, 150*a* of each surface is associated with a first skylight frame member, and a second facet 148*b*, 150*b* of each surface is associated with a second skylight frame member, the two frame members also forming the corner 144 of the frame 18. In one embodiment, the foot 142 is formed by welding, and is integrally secured to the leg by welding. However, the use of fasteners to secure the foot 142 to the leg is also contemplated, as is known in the art. In one embodiment, the foot 142 is formed from a length of 90-degree angle iron, which is then bent or formed to define a 90-degree angle.

Thus, at each of the legs 24, the foot 142 engages the skylight frame 18 at four different locations, namely the corners 144, including two parts of the upper surface 22, one on each of the frame members, and two parts of the peripheral vertical edge 146, one on each of the frame members. The foot 142 rests upon the frame 18, without requiring supplemental fasteners. As such, once the cover 140 is placed upon the skylight frame 18, the enhanced contact area provided by the feet 142 enhances the retention of the cover on the skylight, especially during adverse weather, including high winds. At the same time, the cover 140 is still relatively simple to install on the skylight, as well as to remove once roof repairs are complete.

While particular embodiments of the present adjustable skylight guard have been described herein, it will be appreciated by those skilled in the art that changes and modifications may be made thereto without departing from the invention in its broader aspects and as set forth in the following claims.

The invention claimed is:

1. A skylight guard for placement upon a skylight, said skylight having a skylight frame, comprising:

at least one generally vertical leg having an upper end and a lower end;

at least one horizontal member having a first end, an opposite second end, and a middle portion located between said first and second ends;

at least one of said first and second ends being configured for attachment to said at least one leg;

at least one of said horizontal members being axially variable;

at least one of said vertical legs having a foot associated with said lower end, said foot being constructed and arranged to contact the skylight frame, wherein said foot is in direct contact with an upper surface of the skylight frame; and each of said at least one leg has a surface engaging an edge of the skylight frame, and said surface is on said foot, said foot includes an integral "L"-shaped piece with a generally horizontal surface and a generally vertical surface.

2. The skylight guard of claim 1, wherein each of said at least one leg is a length of angle iron with two non-coplanar surfaces, each of said surfaces contacting a separate edge portion of the frame.

3. The skylight guard of claim 1, wherein said at least one leg has multiple mounting points for connection with each of said at least one horizontal member.

4. The skylight guard of claim 1, wherein said at least one horizontal member is connected at each of said first and second ends to an associate one of said at least one leg.

5. The skylight guard of claim 1, wherein said at least one horizontal member has an upper edge, and a lip projecting laterally from said upper edge.

6. The skylight guard from claim 5, wherein said laterally projecting lip is arranged to support a cover extending over a space defined by a perimeter of the skylight frame.

7. The skylight guard of claim 6, wherein said cover is one of a board and a net.

8. The skylight guard of claim 1, wherein said axial variability of said horizontal member is provided by a first sliding portion and a second sliding portion constructed and arranged to slide relative to said first sliding portion for adjusting an axial length of said horizontal member.

9. The skylight guard of claim 8, wherein said horizontal member further includes one of slots and holes in complementary sliding portions, or clamp members for securing the complementary sliding portions in position.

10. The skylight guard of claim 1, wherein said at least one horizontal member comprises a pair of horizontal members that are vertically spaced.

11. The skylight guard of claim 1, further comprising at least one supplemental support member which is secured to opposing horizontal support members, said at least one supplemental support member being axially variable.

12. A skylight guard for placement upon a skylight, said skylight having a skylight frame, comprising:

at least two generally vertical legs having an upper end and a lower end, the lower end having a surface that engages an edge of the skylight frame;

at least one of said vertical legs having a foot associated with said lower end, said foot being constructed and arranged such as to allow said leg to sit atop the skylight frame, said foot being in direct contact with two vertical edges and an upper surface of the skylight frame, such that the vertical edges and the upper surface of the skylight frame form a corner, and said foot envelops the corner of the skylight frame;

at least one horizontal member having a first end and an opposite second end, both of said ends being configured for attachment to at least one associated site of said at least two legs;

said at least one horizontal member further including a first sliding portion and a second sliding portion constructed and arranged to slide relative to said first sliding portion for adjusting an axial length of said at least one horizontal member; and at least one cover mounted to said at least one horizontal member and extending over a space defined by a perimeter of the skylight frame.

13. The skylight guard of claim 12, wherein said foot includes an integral "L"-shaped piece with a generally horizontal surface and a generally vertical surface.

* * * * *